US011065742B1

(12) United States Patent
Pressey

(10) Patent No.: US 11,065,742 B1
(45) Date of Patent: Jul. 20, 2021

(54) ROTATION AND REMOVAL TOOL FOR AIRLESS SPRAYER TIPS

(71) Applicant: Dennis Pressey, Pemberton, NJ (US)

(72) Inventor: Dennis Pressey, Pemberton, NJ (US)

( * ) Notice: Subject to any disclaimer, the term of this patent is extended or adjusted under 35 U.S.C. 154(b) by 0 days.

(21) Appl. No.: 17/151,603

(22) Filed: Jan. 18, 2021

(51) Int. Cl.

| | |
|---|---|
| ***B25B 13/48*** | (2006.01) |
| ***B67B 7/14*** | (2006.01) |
| ***B05B 15/14*** | (2018.01) |
| ***B25G 1/10*** | (2006.01) |

(52) U.S. Cl.
CPC ..... *B25B 13/48* (2013.01); *B05B 15/14* (2018.02); *B25G 1/102* (2013.01); *B67B 7/14* (2013.01)

(58) Field of Classification Search
CPC ..... B25B 13/48; B67B 7/14; B05B 15/14; B25G 1/02
See application file for complete search history.

(56) References Cited

U.S. PATENT DOCUMENTS 5,005,244 A 4/1991 Muraguchi
2009/0255844 A1* 10/2009 Lingelbach ..... B44D 3/00 206/575

FOREIGN PATENT DOCUMENTS

EP 1295683 A1 3/2003

OTHER PUBLICATIONS

106 Rotoclean ONLY, https://www.roofmaster.com/product/731620-106-rotoclean-only/.
"Czech tool" Stainless Steel Pipe Multi-Tool, https://www.smokecartel.com/products/3pc-stainless-steel-pipe-tool-poker-knife-tamper.
HVLP Spray Gun Cleaning Kit, https://www.rockler.com/hvlp-spraygun-cleaning-kit-sgck1.

* cited by examiner

*Primary Examiner* — David B. Thomas

(57) ABSTRACT

A rotation and removal tool for airless sprayer tips aids in manually manipulating sprayer tips of airless paint sprayers. The rotation and removal tool is provided with an elongated body and a tip receptacle traversing into and within the elongated body. The tip receptacle is configured to releasably receive a sprayer tip of an airless paint sprayer to be retained therein so that the elongated body may be used as a handle to rotate, pull, push or otherwise manipulate a sprayer tip, facilitating easier removal or other maintenance is the sprayer tip has become clogged or jammed. At least one angled grip feature may be provided for ergonomic. A pry lip may be provided to enable can opening functionality. A wrench feature, driver feature, and cleaning prongs may also be included.

12 Claims, 5 Drawing Sheets

ROTATION AND REMOVAL TOOL FOR AIRLESS SPRAYER TIPS

FIELD OF THE INVENTION

The present invention relates generally to painting tools. More particularly, the present invention relates to a tool for manipulating sprayer tips of an airless sprayer.

BACKGROUND OF THE INVENTION

Spray painting is a painting technique in which a device sprays coating material (paint, ink, varnish, etc.) through the air onto a surface. The most common types employ compressed gas—usually air—to atomize and direct the paint particles. Spray guns evolved from airbrushes, and the two are usually distinguished by their size and the size of the spray pattern they produce. Airbrushes are hand-held and used instead of a brush for detailed work such as photo retouching, painting nails, or fine art. Spray guns can be either automated or hand-held and have interchangeable heads to allow for different spray patterns.

Airless spray guns utilize high pressure to atomize and disperse paint using different tip sizes to achieve the desired atomization and spray pattern size. This type of system is often used by contract painters to paint heavy duty industrial, chemical, and marine coatings and linings. Airless spraying has the advantages of improved penetration into pits and crevices, production of a uniform thick coating, reducing the number of coats required, and that the coating is very "wet", ensuring good adhesion and flow-out. Airless spray pumps can be powered by various types of motors in order to achieve the desired pressure.

Airless paint sprayer tips may become clogged or otherwise jammed due to various reasons, from the high pressures involved to paint particles inadvertently landing on the sprayer tip and adhering parts together. This may be a source of frustration to a user, who may struggle with removal of a clogged or jammed sprayer tip.

It is therefore an objective of the present invention to provide a rotation and removal tool for airless sprayer tips that aids the user in removing a clogged or jammed airless sprayer tip, or partially releasing the sprayer tip in order to relieve pressure from the system in order to clear a clog. Various secondary functionalities may also be provided.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a rotation and removal tool for airless paint sprayer tips. The present invention aids a user in rotating, pulling, twisting, turning, and pushing actions for the installation or removal of clogged spray tips of an airless sprayer. The present invention also provides multiple secondary functionalities, including opening of paint cans. The present invention may be constructed from any desirable material, such as, but not limited to, plastic, aluminum, or any other suitable material. The present invention aids users in removal of clogged spray tips without needing to purge the pressure at the spray pump of the airless sprayer in order to rotate the sprayer tip and clear the clog. Though the present invention is directed toward use in manipulation and removal of sprayer tips of airless paint sprayers, it should be noted that the present invention should not be limited in scope to specifically such applications and may be considered as applicable in any other suitable context or in any other relevant application. The word "airless" should not be considered to be limiting and the present invention may be applied for use with any type of fluid sprayer, paint or otherwise, either incorporating the use of air in order to propel the fluid or not, or any type of sprayer tips or nozzles, or any other suitable application.

Figure 1:
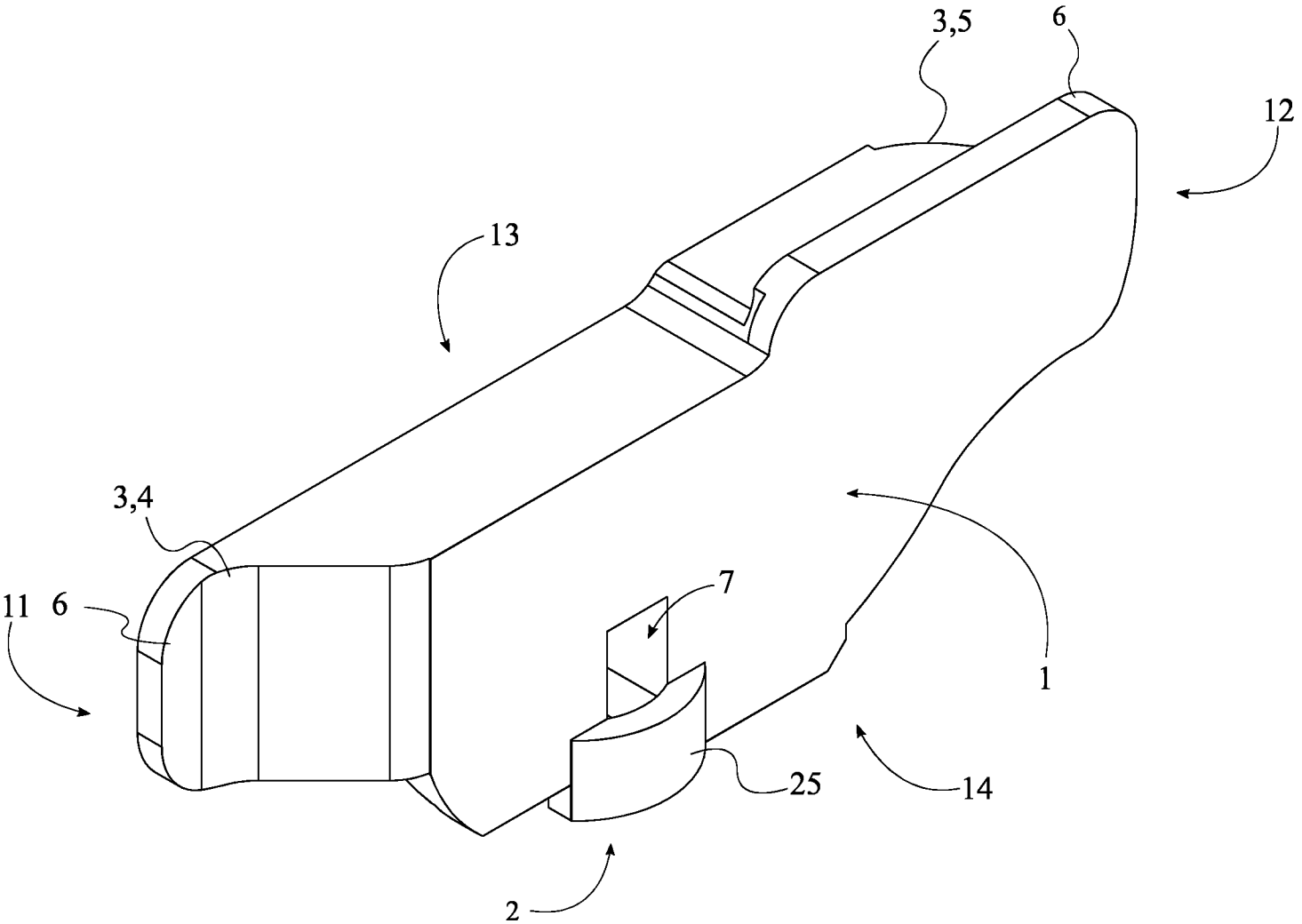
FIG. 1 is a raised perspective view of one embodiment of the present invention.
Figure 2:
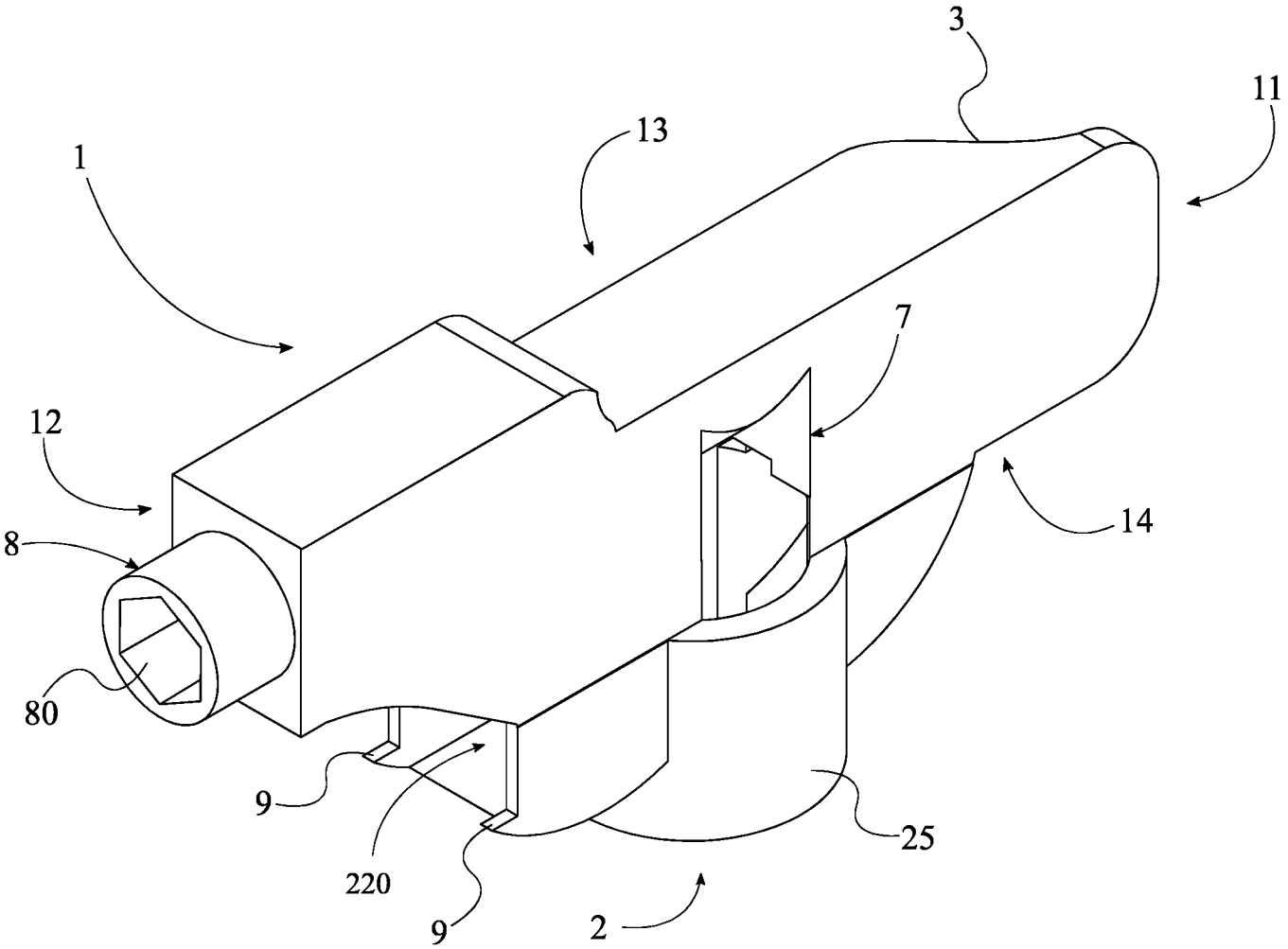
FIG. 2 is a raised perspective view of another embodiment of the present invention.

In general, referring to FIGS. 1-2, the present invention comprises an elongated body 1 and a tip receptacle 2. The elongated body 1 extends longitudinally between a first body end 11 and a second body end 12, and vertically between a top end 13 and a bottom end 14, wherein the longitudinal direction and the vertical direction define a longitudinal plane 10.

The tip receptacle 2 traverses into the bottom end 14 of the elongated body 1 between the first body end 11 and the second body end 12, wherein the tip receptacle 2 is configured through its geometry to receive a handle end of a sprayer tip of an airless paint sprayer, wherein such a sprayer tip comprises a barrel and a handle. The tip receptacle 2 extends longitudinally within the elongated body 1 between the first body end 11 and the second body end 12.

Figure 3:
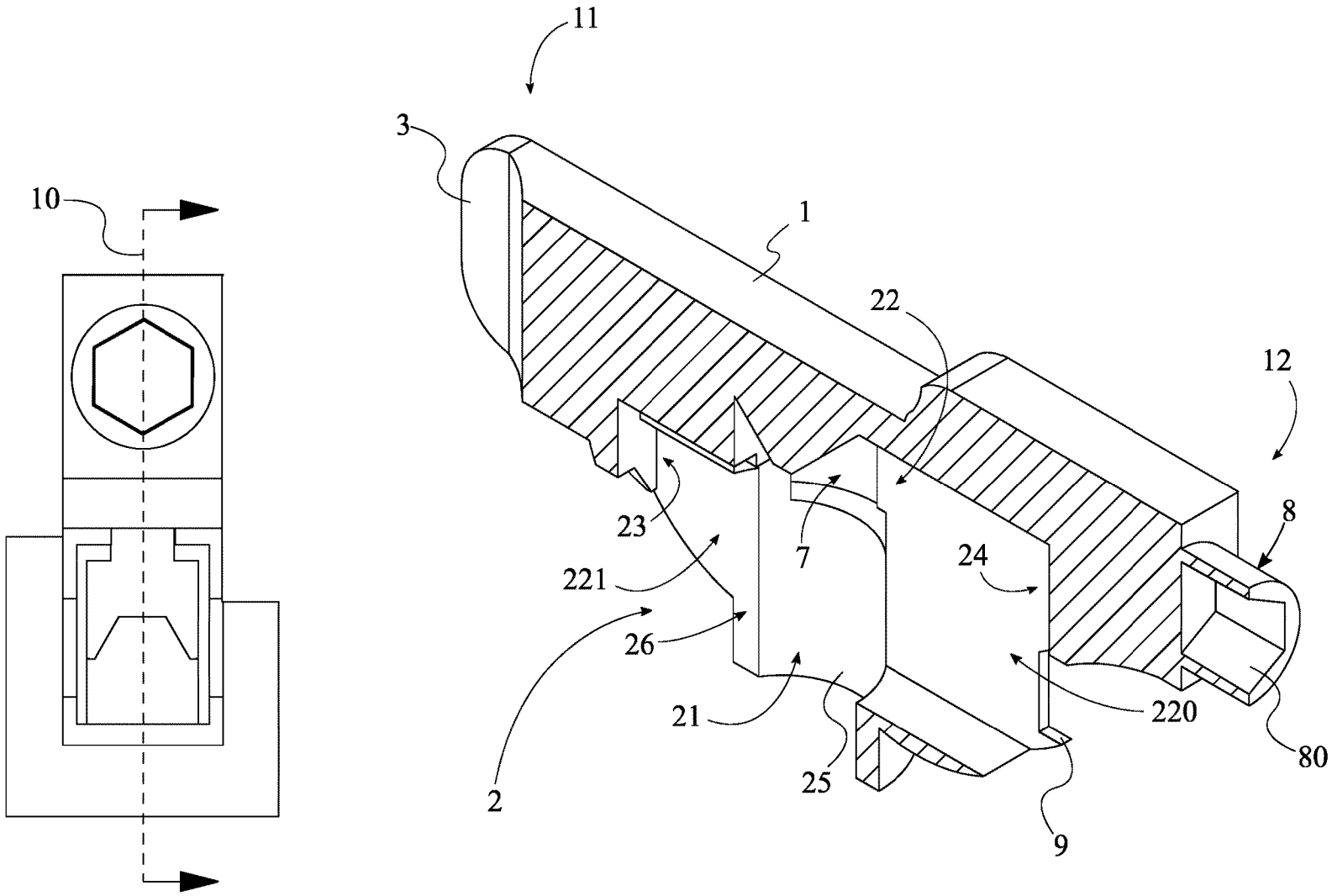
FIG. 3 is a raised perspective cross-sectional view of the embodiment of FIG. 2.

In the preferred embodiment of the present invention, the tip receptacle 2 comprises a barrel cavity portion 21, a handle cavity portion 22, a first cavity end 23, and a second cavity end 24 as shown in FIG. 3, wherein the barrel cavity portion 21 is configured through its geometry to receive the barrel of the aforementioned airless sprayer tip, and wherein the handle cavity portion 22 is configured to receive the handle of the airless sprayer tip. The handle cavity portion 22 longitudinally traverses within the elongated body 1 between the first cavity end 23 and the second cavity end 24. The barrel cavity portion 21 traverses into the bottom end 14 of the elongated body 1 and intersects with the handle cavity portion 22 between the first cavity end 23 and the second cavity end 24.

In the preferred embodiment, the handle cavity portion 22 comprises an enclosed section 220 and an open section 221. The open section 221 is positioned adjacent to the first cavity end 23, and the enclosed section 220 is positioned adjacent to the second cavity end 24, opposite the open section 221 across the barrel cavity portion 21. When in use, the handle of the sprayer tip is positioned by the user into the handle cavity portion 22 such that a tail portion of the tip handle is positioned within the enclosed section 220, such that the tail portion of the tip handle is obstructed on all sides except one by the internal structure of the enclosed section 220. This provides the user the ability to apply leveraging force to the sprayer tip using the present invention in order to pull, twist, rock, or otherwise manipulate the sprayer tip.

In the preferred embodiment, the tip receptacle 2 further comprises an annular barrel receptacle portion 25 and a tip insertion cutout 26. The barrel cavity portion 21 is delineated by the annular barrel receptacle portion 25. The annular barrel receptacle portion 25 preferably has generally annular, cylindrical geometry in order to correspond to the cylindrical geometry typical of airless sprayer tips.

The tip insertion cutout 26 traverses through the annular barrel receptacle portion 25 adjacent to the open section 221 of the handle cavity portion 22, wherein the barrel cavity portion 21 is conjoined with the open section 221 through the tip insertion cutout 26. The presence of the tip insertion cutout 26 is necessary in order to allow insertion of the sprayer tip into the tip receptacle 2; more specifically, to allow passage of the handle of the sprayer tip into the handle cavity portion 22, past the annular barrel receptacle portion 25.

The preferred embodiment of the present invention further comprises at least one angled grip feature 3. Each of the at least one angled grip feature 3 is terminally connected to the elongated body 1 and positioned longitudinally at one of the first body end 11 and/or the second body end 12. The angled grip feature is provided as a feature of convenience in order to afford the user an ergonomic interface for the purpose of rotating the sprayer tip about the axis of its barrel.

Figure 5:
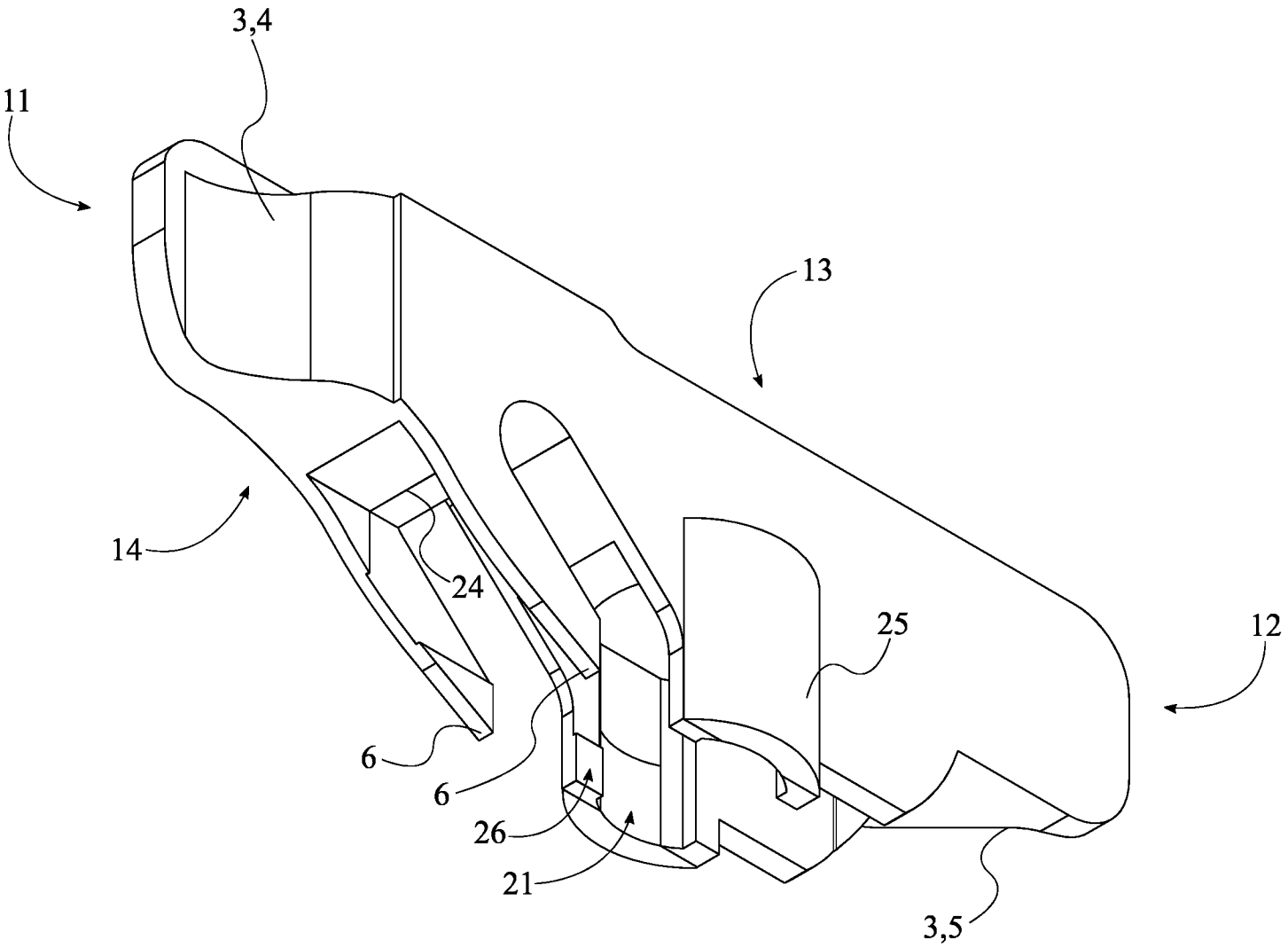
FIG. 5 is a lowered perspective view of another embodiment of the present invention.

More particularly, in some embodiments, the present invention comprises a first angled grip feature 4 and a second angled grip feature 5, as shown in FIGS. 1 and 5. In some embodiments, the first angled grip feature 4 is terminally connected to the elongated body 1 adjacent to the first body end 11, and the second angled grip feature 5 is terminally connected to the elongated body 1 adjacent to the second body end 12. Moreover, the first angled grip feature 4 and the second angled grip feature 5 are oriented oppositely to each other about the longitudinal plane 10. This arrangement provides two radially opposed points of contact to assist in a twisting motion performed by the user.

Preferably, the present invention also includes a feature enabling the user to open cans of paint using the present invention. To this end, in some embodiments, the present invention further comprises at least one pry lip 6, which in general is externally connected to the elongated body 1. More particularly, in some embodiments, the pry lip 6 is connected adjacent to the first angled grip feature 4, opposite the first cavity end 23. Alternatively, in some embodiments, the pry lip 6 is positioned adjacent to the second angled grip feature 5, extending outward from the top end 13 of the elongated body 1. Both possible locations of the pry lip 6 are illustrated in FIG. 1. In some embodiments, the pry lip 6 may be formed simply as a generally rectilinear projection with appropriate thickness to fit underneath the edge of a paint can lid. Alternatively, in some embodiments, the pry lip 6 may comprise one or more angled protrusions or the like, resembling a more conventional can opener feature, as shown in FIG. 5.

In the preferred embodiment, the present invention further comprises a viewing aperture 7 in order to enable the user to easily observe certain identifying markings typically present on the sprayer tip which provide information about its characteristics. The viewing aperture 7 traverses laterally into the elongated body 1 and intersects with the handle cavity portion 22 of the tip receptacle 2. More particularly, in some embodiments, the viewing aperture 7 is longitudinally aligned with the barrel cavity portion 21, though it should be noted that the location of the viewing aperture 7 may vary in different embodiments.

In some embodiments, the present invention further comprises a wrench feature 8 for use on various adjustment nuts and/or spray tools the user may encounter in their use of an airless paint sprayer. that is externally connected to the elongated body 1. Preferably, the wrench feature 8 comprises a hexagonal socket 80, though it should be noted that the wrench feature 8 may be implemented in any desired configuration which enables its intended use. The location of the wrench feature 8 may vary as desired, though in some embodiments, the wrench feature 8 is terminally connected to the elongated body 1 at the second body end 12. Additionally, the present invention may comprise, in various embodiments, various additional ancillary features that may provide various benefits and capabilities to the user. For example, in addition to the wrench feature, the present invention may further incorporate a driving feature, such as, but not limited to, one or a driver features such as, but not limited to, one or more flat head, Phillips head, Allen head, or Torx head driver features. Such driver feature(s) may be connected to the elongated body 1, or any other suitable location on the present invention.

Figure 4:
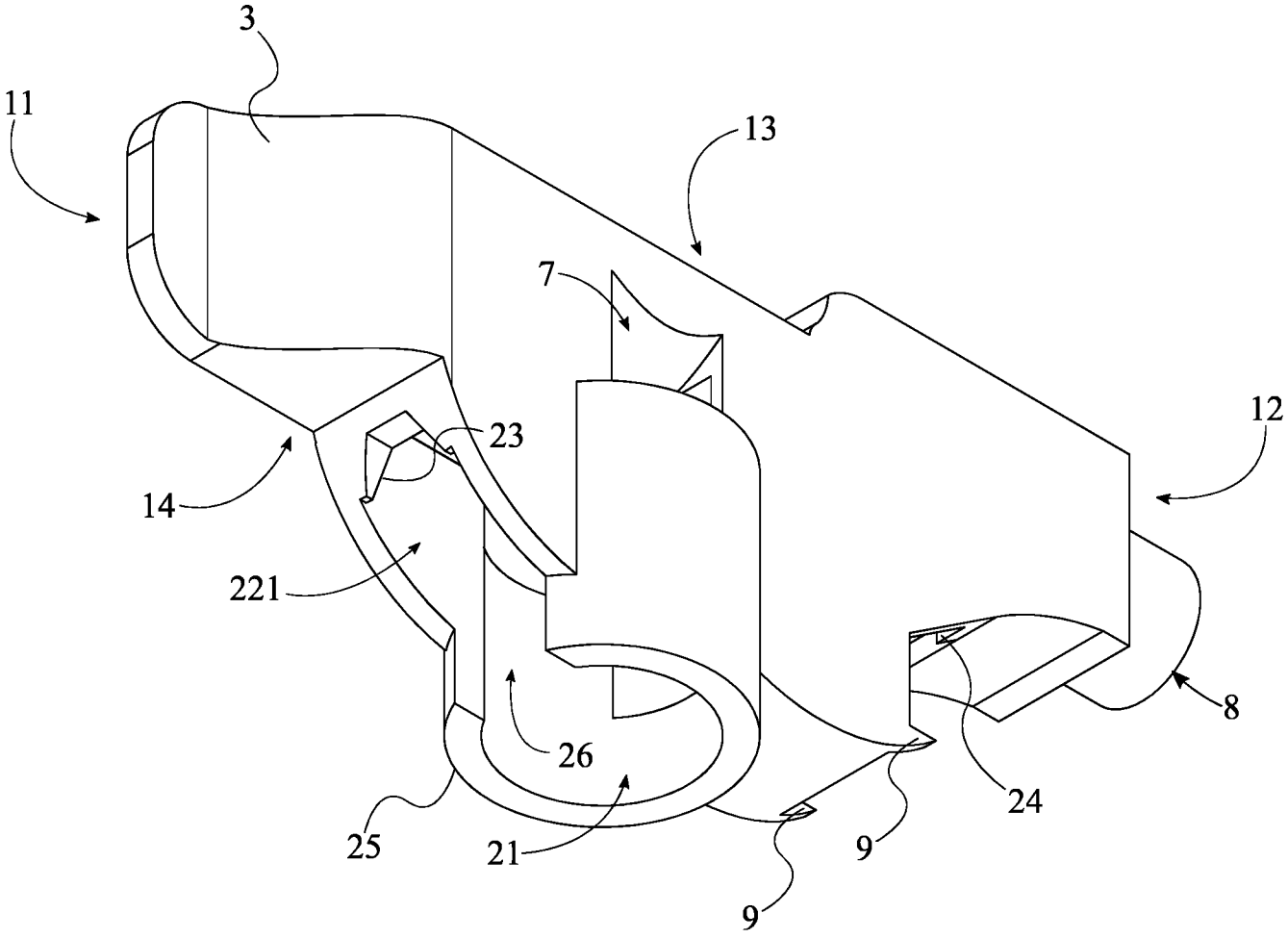
FIG. 4 is a lowered perspective view of the embodiment of FIGS. 2-3.

Referring to FIGS. 2-4, in some embodiments, the present invention may comprise at least one prong 9 externally connected to the elongated body 1. The at least one prong 9 is provided to aid in removing paint skins, cleaning sprayer tips, and various other related activities. The specific location of the at least one prong 9 may vary in different embodiments. In some embodiments, the at least one prong 9 is positioned adjacent to the second cavity end 24, external to the handle cavity portion 22 of the tip receptacle 2, between the second body end 12 and the annular barrel cavity portion 21.

Although the invention has been explained in relation to its preferred embodiment, it is to be understood that many other possible modifications and variations can be made without departing from the spirit and scope of the invention as hereinafter claimed.

What is claimed is:

1. A rotation and removal tool for airless sprayer tips comprising:

an elongated body;

a tip receptacle;

the elongated body extending longitudinally between a first body end and a second body end, and vertically between a top end and a bottom end, wherein the longitudinal direction and the vertical direction define a longitudinal plane;

the tip receptacle traversing into the bottom end of the elongated body between the first body end and the second body end, wherein the tip receptacle is configured to receive a sprayer tip of an airless sprayer, wherein the sprayer tip comprises a barrel and a handle;

the tip receptacle extending longitudinally within the elongated body between the first body end and the second body end;

the tip receptacle comprising a barrel cavity portion, a handle cavity portion, a first cavity end, and a second cavity end, wherein the barrel cavity portion is configured to receive a barrel of an airless sprayer tip, and wherein the handle cavity portion is configured to receive a handle of an airless sprayer tip;

the handle cavity portion longitudinally traversing within the elongated body between the first cavity end and the second cavity end;

the barrel cavity portion traversing into the bottom end of the elongated body and intersecting with the handle cavity portion between the first cavity end and the second cavity end;

the handle cavity portion comprising an enclosed section and an open section;

the open section being positioned adjacent to the first cavity end; and the enclosed section being positioned adjacent to the second cavity end, opposite the open section across the barrel cavity portion.

2. The rotation and removal tool for airless sprayer tips as claimed in claim 1 comprising:

the tip receptacle further comprising an annular barrel receptacle portion and a tip insertion cutout;

the barrel cavity portion being delineated by the annular barrel receptacle portion; and the tip insertion cutout traversing through the annular barrel receptacle portion adjacent to the open section of the handle cavity portion, wherein the barrel cavity portion is conjoined with the open section through the tip insertion cutout.

3. The rotation and removal tool for airless sprayer tips as claimed in claim 1 comprising:

at least one angled grip feature; and each of the at least one angled grip feature being terminally connected to the elongated body.

4. The rotation and removal tool for airless sprayer tips as claimed in claim 1 comprising:

a first angled grip feature;

a second angled grip feature;

the first angled grip feature being terminally connected to the elongated body adjacent to the first body end;

the second angled grip feature being terminally connected to the elongated body adjacent to the second body end; and the first angled grip feature and the second angled grip feature being oriented oppositely to each other about the longitudinal plane.

5. The rotation and removal tool for airless sprayer tips as claimed in claim 1 comprising:

a pry lip; and the pry lip being externally connected to the elongated body.

6. The rotation and removal tool for airless sprayer tips as claimed in claim 1 comprising:

a pry lip;

a first angled grip feature;

the first angled grip feature being terminally connected to the elongated body adjacent to the first cavity end; and the pry lip being connected adjacent to the first angled grip feature, opposite the first cavity end.

7. The rotation and removal tool for airless sprayer tips as claimed in claim 1 comprising:

a viewing aperture; and the viewing aperture traversing laterally into the elongated body and intersecting with the handle cavity portion of the tip receptacle.

8. The rotation and removal tool for airless sprayer tips as claimed in claim 7 comprising:

the viewing aperture being longitudinally aligned with the barrel cavity portion.

9. The rotation and removal tool for airless sprayer tips as claimed in claim 1 comprising:

a wrench feature; and the wrench feature being externally connected to the elongated body.

10. The rotation and removal tool for airless sprayer tips as claimed in claim 9 comprising:

the wrench feature comprising a hexagonal socket.

11. The rotation and removal tool for airless sprayer tips as claimed in claim 1 comprising:

at least one prong; and each of the at least one prong being externally connected to the elongated body.

12. The rotation and removal tool for airless sprayer tips as claimed in claim 11 comprising:

the at least one prong being positioned adjacent to the second cavity end, external to the handle cavity portion.

* * * * *